United States Patent [19]

Kamegaya et al.

[11] Patent Number: 4,529,909

[45] Date of Patent: Jul. 16, 1985

[54] GAS DISCHARGE DISPLAY PANEL

[75] Inventors: Takeo Kamegaya, Tokyo; Tadahiko Sekigawa, Saitama; Hiroshi Kurakami, Saitama; Yoshiro Suzuki, Saitama, all of Japan

[73] Assignee: Okaya Electric Industries Co., Ltd., Tokyo, Japan

[21] Appl. No.: 471,613

[22] Filed: Mar. 3, 1983

Related U.S. Application Data

[62] Division of Ser. No. 254,715, Apr. 16, 1981, Pat. No. 4,392,075.

[30] Foreign Application Priority Data

Apr. 21, 1980 [JP] Japan ..... 55-52607
Jun. 30, 1980 [JP] Japan ..... 55-89431
Sep. 12, 1980 [JP] Japan ..... 55-126923

[51] Int. Cl.[3] ..... H01J 61/35
[52] U.S. Cl. ..... 313/584; 313/605
[58] Field of Search ..... 313/581, 584, 585, 586, 313/587, 605, 606, 631, 632, 491, 582

[56] References Cited

U.S. PATENT DOCUMENTS 3,704,386 11/1972 Cola ..... 313/585 X
3,842,308 10/1974 van Esdonk et al. ..... 313/584
3,938,135 2/1976 DeJoule et al. ..... 313/584 X
3,975,725 8/1976 Ogle ..... 313/582 X
3,992,644 11/1976 Chodil et al. ..... 313/491 X
4,010,395 3/1977 Holz ..... 313/585
4,031,429 6/1977 Holz et al. ..... 313/584 X
4,392,075 7/1983 Kamegaya et al. ..... 313/584
4,472,659 9/1984 Kamegaya et al. ..... 313/584

*Primary Examiner*—David K. Moore
*Assistant Examiner*—K. Wieder
*Attorney, Agent, or Firm*—Sughrue, Mion, Zinn, Macpeak, and Seas

[57] ABSTRACT

A gas discharge display panel for a large screen display in which the display brightness and emission efficiency are very high, the display accuracy is high, and is simple to construct. Cathode electrodes having openings forming discharge cells are arranged in parallel on a front plate and a number of anode electrodes are arranged in parallel on a rear plate orthogonal to the cathode electrodes. Each opening in the cathode electrodes may be rectangular, substantially rectangular or circular. The length of one side of a rectangular opening or the diameter of a circular opening is set to satisfy $40\lambda_e \leqq D \leqq 500\lambda_e$ while the thickness of the cathode electrode is $10\lambda_e \leqq T \leqq 100\lambda_e$, where $\lambda_e$ is the mean free path of electrons in a gas sealed in the display panel.

29 Claims, 23 Drawing Figures

GAS DISCHARGE DISPLAY PANEL

This is a division of application Ser. No. 254,715, filed Apr. 16, 1981, now U.S. Pat. No. 4,392,075.

BACKGROUND OF THE INVENTION

The present invention relates to a gas discharge display panel suitable for a large screen display in which the display brightness and light emission efficiency are improved and which has a high display accuracy. More specifically, the invention is intended to provide a gas discharge display panel suitable for a large screen display in which, with the size of each opening in cathode electrodes and the thickness of each cathode electrode suitably determined and/or the size of each discharge cell determined so as to be large compared with the size of the opening of the cathode electrodes, the distance between the front plate of the display panel and each cathode electrode is suitably determined in order to improve the display brightness and light emission efficienty. It is desired to accomplish this with no spacer employed thereby making the overall construction considerably simple.

An example of a conventional gas discharge display panel is shown in FIG. 1. In the gas discharge display panel 1, a number of ribbon-shaped or line-shaped anode electrodes 2 are arranged in parallel and a spacer 4 having a number of round holes 3 in which discharge takes place is disposed over the anode electrodes 2. A number of ribbon-shaped cathode electrodes 6 are arranged over the spacer 4 in such a manner that the cathode electrodes 6 are orthogonal with the anode electrodes 2. Small round holes 5 are cut in the cathode electrodes 6. The cathode electrodes 6 and anode electrodes 2 thus arranged are held through spacers 7 and 8 by a front plate 9 and a rear plate 10 which may, for instance, be glass plates. The front and rear plates 9 and 10 form the opposed outer walls of the display panel. The outer walls are sealed at peripheral portions thereof to form a vacuum container or envelope in which a gas containing primarily an inactive gas such as neon, argon, helium, xenon or crypton is sealed.

The conventional gas discharge display panel described above is disadvantageous in that if the capacity or the resolution power is increased, the display brightness and light emission efficiency are decreased.

As described above, the spacers 4, 7 and 8 are arranged in three layers in the conventional gas discharge display panel. These spacers suffer from problems in that, since their thickness is very small, typically about $200\mu$, the spacers are liable to bend when used for a large area display, that is, it is difficult to maintain them flat. Moreover, the spacers are difficult to produce making their cost high. Furthermore, the work needed to assemble the display panel using the spacers 4, 7 and 8 is intricate. Cutting a large number of small holes forming discharge cells in the spacers is costly. In addition, handling the components is troublesome in assembling the display panel. Thus, the conventional display panel is not suitable for a large screen display and it has a relatively low resolution power.

The conventional display panel will be described in more detail. FIG. 8A ia a sectional view of the conventional display panel shown in FIG. 1. In FIG. 8A, reference numeral 11 designates a discharge cell, and 12 a space for forming a negative glow 13 between the front plate 9 and the cathode electrode 6. The thickness 5 of the spacer 7 is usually four to 25 times the mean distance between collisions (means free path) $\lambda_e$ of electrons and ions in a plasma created by the discharge.

In the operation of the conventional display panel, the negative glow 13 spreads downwardly from the edge of the opening 5 in the cathode electrode 6 as shown in the figure. More specifically, if the thickness S of the spacer 7 is set, for instance, to $6\lambda_e$, the discharge display state of the display panel will be as shown in FIG. 8A. That is, the negative glow 13 spreads out downwardly from the central portion of the side wall of the opening 5. If the negative glow is viewed from above the front plate 9, it appears as shown in FIG. 8B. That is, the negative glow spreads only along the edge of the opening with no glow being effected in the center of the opening 5. If the thickness S of the spacer 7 is $20\lambda_e$, the negative glow 13 spreads as shown in FIG. 8C. More specifically, in this case, although the negative glow does not spread over the upper surface of the cathode electrode 6, it spreads from the side wall of the opening 5 to the lower surface of the cathode electrode 6. If the negative glow is observed from above the front plate 9, the negative glow appears as shown in FIG. 8D. That is, the negative glow spreads substantially throughout the entire area of the opening 5 except for the center.

More generally, if the thickness of the spacer 7 is in the range of from $6\lambda_e$ to $20\lambda_e$, the negative glow 13 does not spread over the upper surface of the cathode electrode 6 or towards the front plate 9. If it is attempted to cause the negative glow 13 to spread towards the front plate 9 by increasing the discharge current, it is difficult to form the negative glow 13 because of the charge particle loss to the front plate 9. Even if the negative glow were formed, it would be unstable. The discharge light emission of the negative glow 13 is limited as shown in FIGS. 8B and 8D, and accordingly the display brightness is low and the light emission efficiency is also low.

If the thickness of the spacer 7 is in the range of from $20\lambda_e$ to $25\lambda_e$, because of variations in dimensions of the discharge cells during manufacture, the negative glow will spread over the upper surface of the cathode electrode 6 or towards the front plate 9 in some discharge cells but not in other discharge cells. Thus, in this case, the discharge display is not stable.

SUMMARY OF THE INVENTION

In view of the foregoing, a primary object of the invention is to provide a gas discharge display panel in which the configuration of openings in cathode electrodes is selected to provide suitable hollow cathode electrodes, and at least one of the thickness of the cathode electrodes, the positional relationships of the cathode electrodes or the size of the openings in the cathode electrodes is set in a predetermined range with respect to the electrode mean free path in a gas sealed in the display panel to obtain a hollow cathode effect, whereby small cathode electrodes supply large discharge currents and high brightness and high efficiency are obtained at low operating voltages.

Another object of the invention is to provide a gas discharge display panel suitable for a large screen display which is composed of two structural memebers without using spacers.

The foregoing objects and other objects of the invention have been achieved by the provision of a gas discharge display panel composed of a number of cathode electrodes having openings forming discharge cells which are arranged in parallel on the front plate side, and a number of anode electrodes arranged in parallel on the rear plate side orthogonal to the cathode electrodes. Each opening in the cathode electrodes is rectangular, substantially rectangular or circular. More specifically, in the case where the openings in the cathode electrodes are rectangular or substantially rectangular, the length $D_2$ of one side of the rectangular opening and the thickness T of the cathode electrodes are so selected as to meet the following expressions:

$$40\lambda_e \leqq D_2 < 500\lambda_e, \text{ and} \quad (1)$$

$$10\lambda_e \leqq T \leqq 100\lambda_e, \quad (2)$$

where $\lambda_e$ is the electron free path in the gas sealed in the display panel. In the case where the openings in the cathode electrodes are circular, the diameter $D_{2'}$ of each circular opening and the thickness T' of each cathode electrode are so selected as to meet the following expressions:

$$40\lambda_e \leqq D_{2'} \leqq 500\lambda_e, \text{ and} \quad (1)'$$

$$10\lambda_e \leqq T' \leqq 100\lambda_e, \quad (2)'$$

Furthermore, in order to achieve the foregoing objects, the distance S between the front plate and each cathode electrodes in the discharge space forming the negative glow is defined by the following expression (4) under the conditions that the aforementioned length $D_2$ and the size $D_1$ of the discharge cell (which, in the case where the discharge cell is in the form of a square or substantially in the form of a square, is the length of each side thereof, and in the case where the discharge cell is in the form of a circle, is the diameter thereof) satisfy the following expressions:

$$D_1 > D_2,\ 25\lambda_e \leqq D_1 \leqq 500\lambda_e, \text{ and} \quad (3)$$

$$25\lambda_e \leqq S \leqq 70\lambda_e. \quad (4)$$

In addition, if the size and the thickness of each cathode electrode and the space between the front plate and each cathode in the discharge cell are selected so as to simultaneously satisfy the above-described expressions (1) and (2) or (1)' and (2), and (3) and (4), the display brightness and light emission efficiency of the panel are remarkably improved.

The nature, principle and utility of the invention will become more apparent from the following detailed description when read in conjunction with the accompanying drawings.

DESCRIPTION OF THE PREFERRED EMBODIMENTS

Figure 1:
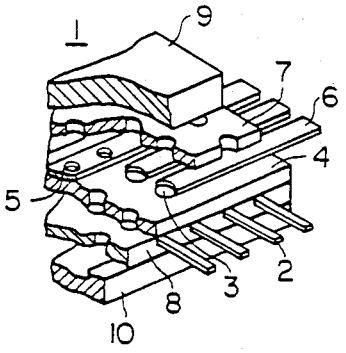
FIG. 1 is a schematic perspective view showing an example of a conventional gas discharge display panel.
Figure 2:
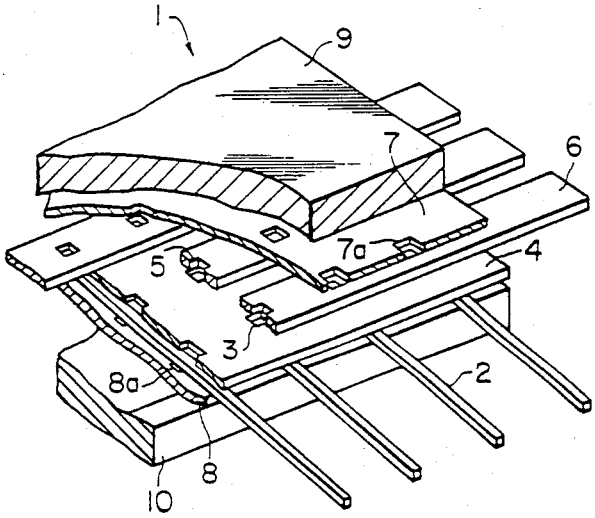
FIG. 2 is a schematic perspective view showing a preferred embodiment of a gas discharge display panel according to the invention.
Figure 3:
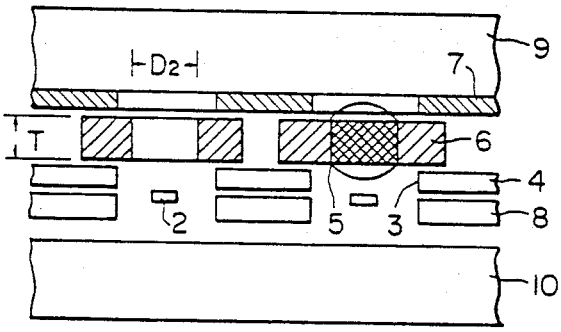
FIG. 3 is a schematic side view of the gas discharge display panel of the invention.

A preferred embodiment of a gas discharge display panel having cathode electrodes with rectangular openings according to the invention is shown in FIG. 2 in which those components which have been described with reference to FIG. 1 are therefore similarly numbered.

In FIG. 2, a spacer 4 is provided which has rectangular openings 3 which are arranged horizontally and vertically at predetermined intervals. Rectangular openings 5 smaller than the rectangular openings 3 are cut in cathode electrodes 6. In addition, openings 7*a* and 8*a*, having the same size as the openings 3, are cut in spacers 7 and 8, respectively. These openings are aligned with the gas discharge display panel to provide discharge spaces for the cathodes 6 and anodes 2 so that a discharge display is observed through a front panel 9.

Similarly as in the above-described conventional gas discharge display panel, the front panel 9 and a rear panel 10 respectively form outer walls of the display panel. The outer wall, and hence the display panel, are sealed at the peripheral portions. After the display panel has been evacuated, an inactive gas such as argon, xenon or krypton is sealed in the display panel.

The corners of the rectangular openings of the cathode electrodes 6 in the display panel thus formed provide a hollow cathode effect. The provision of a gas discharge display panel utilizing this effect satisfies a fisrt object of this invention.

A general hollow cathode discharge will be briefly described. An electric discharge effected when the inner wall of a cylindrical or conical electrode is used as a cathode or when parallel electrodes are arranged opposed to each other and the inner surfaces thereof are used as common cathodes is called a hollow cathode discharge. General characteristic features of a hollow cathode discharge are: (1) the current density is much larger than that in a regular glow discharge, (2) the discharge maintaining voltage is lower, (3) the plasma density in the cathode space is higher, (4) the thickness of the cathode dark space is smaller, (5) the light radiation intensity is higher, (6) the vapor density of cathode metal in the cathode space is higher, and (7) the amount of sputtering is less.

The invention thus utilizes these advantageous effects of a hollow cathode discharge for improving the brightness and light emission efficiency of the gas discharge display panel.

Figure 4:
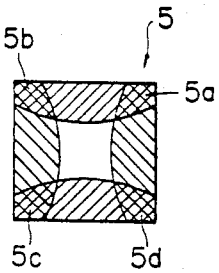
FIG. 4 is an explanatory diagram showing a state of the discharge in an opening formed in a cathode electrode in the display panel of the invention.

The present inventors have found through experiments performed on cathodes of different configurations that, if an opening in a cathode is rectangular, as the portions of the cathode confronting four corners 5*a*, 5*b*, 5*c* and 5*d* of the opening 5 are close to one another, the negative glows overlap one another as shown in FIG. 4 thus causing the hollow cathode effect. Furthermore, in order to improve the effects of the rectangular openings 5 in the cathode, the inventors have carried out experiments in which the thickness of the cathode was changed. The results of these experiments will be described with reference to FIG. 5.

Figure 5:
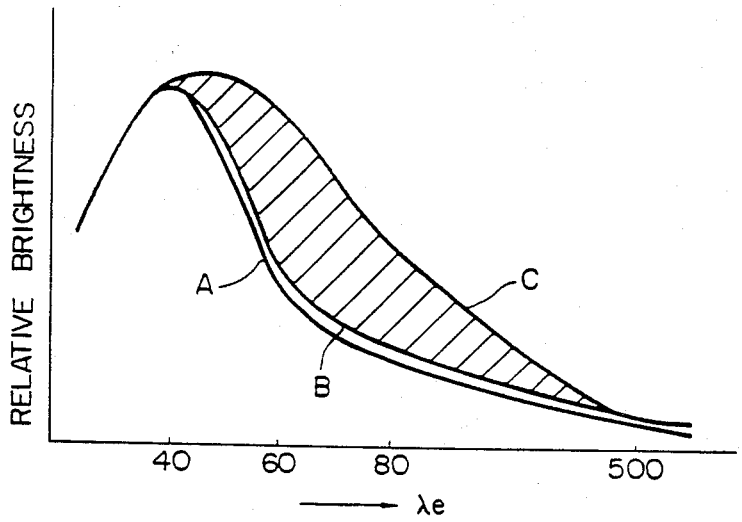
FIG. 5 is a graphical representation indicating relative brightness values in a case where the cathode electrode openings are circular, in a case where the openings are rectangular and the thickness of the cathode electrode is $10\lambda_e$, and in a case where the openings are rectangular and the thickness of the cathode electrode is $100\lambda_e$.

In FIG. 5, curve A indicates the relative brightness of a small round hole in a cathode electrode of a conventional gas discharge display panel, curve B indicates the relative brightness in a case where the cathode has a thickness of $10\lambda_e$ and the opening is rectangular, and curve C indicates the relative brightness in the case where the cathode has a thickness of $100\lambda_e$ and the opening is rectangular.

It may be seen from the graphical representation of FIG. 5 that, in order to effectively utilize the hollow cathode discharge for the gas discharge display panel, the dimension $D_2$ of the opening in the cathode, or the dimension of one side of the square opening, and the thickness T of the cathode should be defined as follows:

$$40\lambda_e \leqq D_2 \leqq 500\lambda_e, \text{ and} \quad (1)$$

$$10\lambda_e \leqq T \leqq 100\lambda_e, \quad (2)$$

The discharge voltage and current characteristic of the gas discharge display panel of the invention was compared with that of a conventional gas discharge display panel using the flat cathodes. The results of these comparison are as shown in FIG. 6.

Figure 6:
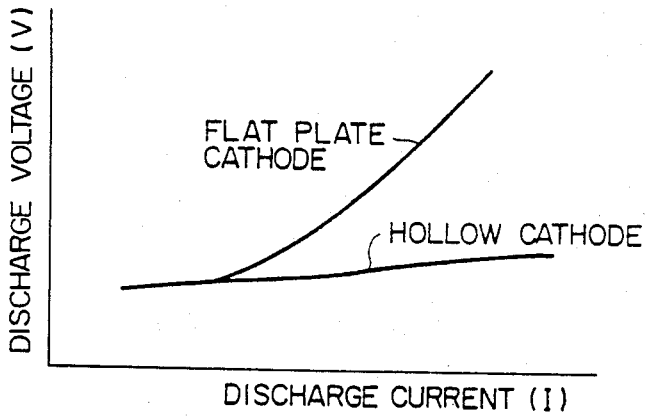
FIG. 6 is a graphical representation indicating the discharge voltage vs. discharge current characteristic of the display panel of the invention and that of the conventional gas discharge display panel.

As is apparent from FIG. 6, in the conventional display panel using the flat plate cathodes, the discharge voltage V increases substantially in proportion to the discharge current I, while in the display panel of the invention, even if the discharge current I is increased, the discharge voltage V is increased only a little. Moreover, this tendency becomes more significant as the thickness is increased.

Thus, in the gas discharge display panel utilizing the hollow cathode effect according to the invention, with a small cathode size, the cathode current is increased, the cathode drop voltage is decreased, and the quantity of sputtering is reduced. Thus, a gas discharge display panel which has a high brightness and low operating voltage and in which sputtering is suppressed is provided by the invention.

FIGS. 7A–7G show modifications of the opening in the cathode electrode. In a first modification shwon in FIG. 7A, the opening is substantially rectangular but the four sides are curved inwardly. In a second modification in FIG. 7B, the opening is similar to that in FIG. 7A but the four corners are cut away. In a third modification in FIG. 7C, the configuration of the opening is a square with small circles protruding from the four corners. In each of the first through third modifications, the four sides have the same general size having a dimension $D_2$, and the configuration of the opening appearing on the upper surface of the cathode is the same as that of the opening appearing on the lower surface.

Figure 7A:
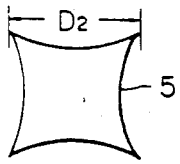
FIGS. 7A, 7B and 7C are plan views showing modifications of the cathode electrode opening according to the invention.
Figure 7B:
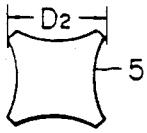
Figure 7C:
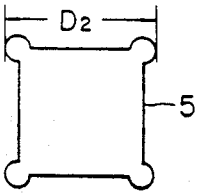
Figure 7D:
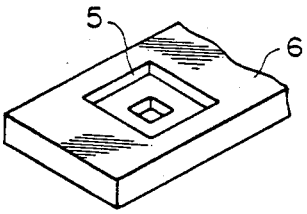
FIGS. 7D and 7F are, respectively, a perspective view and a sectional view showing another modification of the cathode electrode opening according to the invention.
Figure 7E:
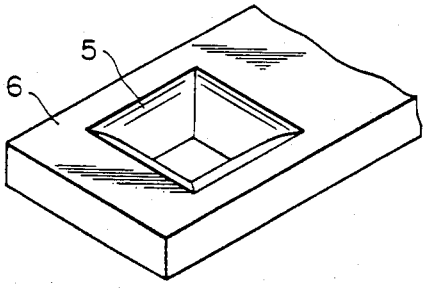
FIGS. 7E and 7G are a perspective view and a sectional view, respectively, showing another modification of the cathode electrode opening according to the invention.
Figure 7F:
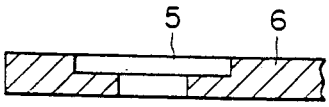

On the other hand, in fourth and fifth modifications of the opening shown in FIGS. 7D and 7E, the opening appears square both on the upper and lower surfaces of the cathode although the upper square is larger than the lower square. More specifically, in the fourth modification in FIGS. 7D and 7F, the opening 5 has a shoulder or step midway so that each sides of the square appearing on the upper surface of the cathode is longer than each side of the square appearing on the lower surface of the cathode.

Figure 7G:
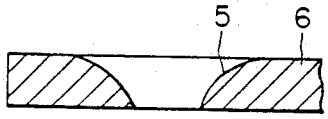

In a fifth modification in FIGS. 7E and 7G, the dimension $D_2$ of each side of the square appearing on the upper surface of the cathode gradually decreases in the downward direction. That is, the opening is substantially in the form of a frustum of pyramid. Any one of the above-described modifications produces the same effects if, with respect to the electron mean free path $\lambda_e$, each side $D_2$ of the opening in the cathode and the thickness T of the cathode satisfy the conditions (1) and (2).

A gas discharge display panel may be formed having a round opening in a cathode electrode and, with respect to the mean free path $\lambda_e$, the diameter $D_2$, of the round opening and the thickness T' of the cathode electrode satisfy the following conditions:

$$40\lambda_e \leqq D_{2'} \leqq 500\lambda_e, \text{ and} \quad (1)'$$

$$25\lambda_e \leqq T' \leqq 100\lambda_e. \quad (2)'$$

If, also in this display panel, the thickness of the cathode is defined by these conditions, the light emission effect of the negative glow will be efficiently obtained and therefore the brightness and light emission efficiency of the panel improved.

Figure 8A:
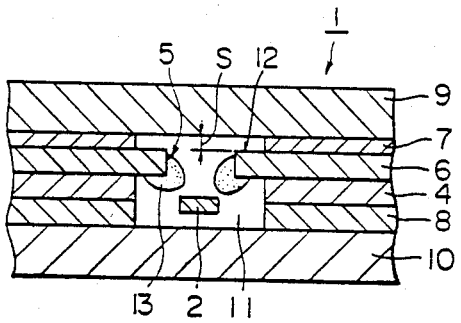
FIGS. 8A and 8C are sectional view of the essential components of conventional gas discharge display panels.
Figure 8B:
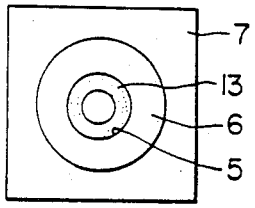
FIGS. 8B and 8D are plan view showing glow discharges in the display panels in FIGS. 8A and 8C, respectively.
Figure 8C:
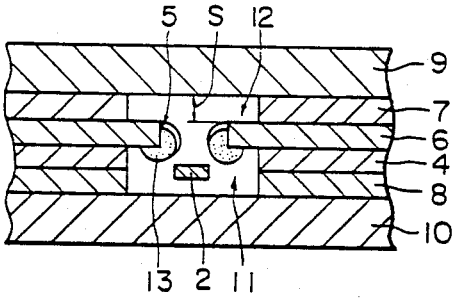
Figure 8D:
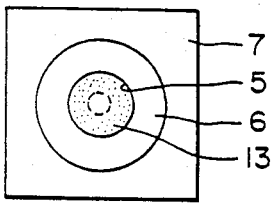
Figure 8E:
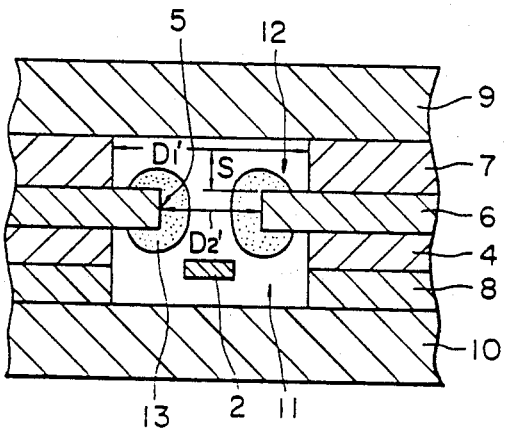
FIG. 8E is a sectional view of essential components in the gas discharge display panel according to the invention.
Figure 8F:
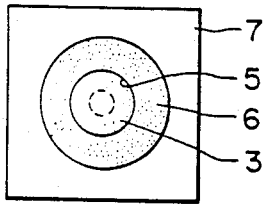
FIG. 8F is a plan view showing a glow discharge in the display panel in FIG. 8E.

Next, selection of the diameter $D_1$, of the discharge cell 11, the diameter $D_2$, of the opening in the cathode electrode 6, and the distance S between the front plate 9 and the cathode electrode 6 will be described with reference to FIGS. 8E and 8F.

In a DC type gas discharge display panel according to a second embodiment of the invention, the distance S between the front plate 9 and the cathode electrode 6 in the discharge space where a negative glow 13 is created is selected so as to satisfy the following expression (4) with the diameters $D_{1'}$ and $D_{2'}$ meeting the following exprssion (3).

$$D_{1'} > D_{2'},\ 25\lambda_e \leqq D_{1'} \leqq 500\lambda_e, \text{ and} \quad (3)$$

$$25\lambda_e \leqq S \leqq 70\lambda_e, \quad (4)$$

where $\lambda_e$ is the mean free path of electrons in a plasma atmosphere created by the discharge.

In other words, the distance S in the discharge space 12 for generating the negative glow 13 between the front plate 9 and the cathode electrode 6 is set to more than $25\lambda_e$. With this value, charged particle loss with the front plate is scarcely caused. By setting the distance S to less than $70\lambda_e$, the negative glow can well be visually observed. For instance, in the case where the main gas component is Ne and the gas pressure P is 120 Torr with a corresponding value of $\lambda_e$ of 5 $\mu$m, the negative glow can be visually observed even if the distance S is increased to 350 $\mu$m. Furthermore, in accordance with the invention, the diameter 1' of the discharge cell 11 and the diameter $D_{2'}$ of the opening in the cathode electrode 6 are selected so as to satisfy the condition $D_{1'} > D_{2'}$. Because of this selection, there is no difficulty that the negative glow 13 expands forming gaps in the discharge and nor that the discharge start voltage is considerably increased to an impractical extent.

The gas pressure P is set between the lower limit value 70 Torr below which the amount of sputtering is increased and the discharge start voltage is increased and the upper limit value 300 Torr above which a so-called "discharge concentration" occurs making it difficult for the negative glow 13 to uniformly distribute and again increasing the discharge start voltage. Also, the diameter $D_1$, of the discharge cell 11 is selected so as to meet the condition $25\lambda_e \leqq D_{1'} \leqq 500\lambda_e$ with which the discharge display is stable.

That is, as the diameter $D_{1'}$ of the discharge cell 11 is decreased, the charged particle loss with the spacer 7 is increased. If the diameter $D_{1'}$ is smaller than $25\lambda_e$, it is impossible to stably maintain the discharge making it considerably difficult to generate the negative glow over the upper surface of the cathode electrode 6.

The charged particle loss increases as the discharge gas pressure P is decreased. Based on this, experiments were carried out with the gas pressure P set to a lower value in the pressure range of from 70 Torr to 300 Torr as a result of which the lower limit value $25\lambda_e$ was obtained for the diameter $D_{1'}$. The experiments were carried out as follows: Using a pressure of P=75 Torr with a corresponding mean free path $\lambda_e = 8$ $\mu$m, it was determined that with $D_{1'} = 0.2$ mm the negative glow 13 was stably generated over the upper surface of the cathode electrode 6. In the case of P=100 Torr where $\lambda_e = 6$ $\mu$m, it was determined that with $D_{1'} = 0.15$ mm the negative discharge 12 was stably generated over the upper surface of the cathode electrode 6.

On the other hand, as the diameter $D_{1'}$ of the discharge cell 11 is increased, the discharge area of the cathode electrode 6 of course increased. However, if the diameter $D_{1'}$ is made larger than $500\lambda_e$, then it becomes difficult to form a uniform negative glow over the entire cathode electrode 6. The non-uniformity in distribution of the negative glow due to the discharge concentration becomes significant with increasing discharge gas pressure P.

Based on this, experiments were carried out with the gas pressure P set to a higher value in the pressure range of from 70 Torr to 300 Torr, as a result of which the upper limit value $500\lambda_e$ was obtained for the diameter $D_{1'}$. The experiments were carried out as follows: With a pressure P=300 Torr, corresponding to $\lambda_e = 2$ $\mu$m, it was observed that with $D_{1'} = 1.0$ mm a uniform negative glow was generated over the entire surface of the cathode electrode. For P=150 Torr and $\lambda_e = 4$ $\mu$m, with $D_{1'} = 2.0$ mm a uniform negative glow was generated over the entire surface of the cathode electrode.

By selecting the distance S so as to satisfy the expression (4) with the diameters $D_{1'}$ and $D_{2'}$ meeting the expression (3) as described above, the negative glow 13 is spread from the upper surface of the cathode electrode 6 to the periphery of the opening 5 and to the lower surface of the cathode electrode 6. That is, the thickness of the negative glow 13 in the direction of display, the vertical direction, is increased. At the same time, the light emission display area, as viewed from the front plate side, is extended from the periphery of the opening 5 outwardly to the front plate 9 and hence the light emission display area is greatly increased. Accordingly, the brightness and light emission efficiency of the display panel are improved, the quantity of metal material sputtered from the cathode electrode 6 is reduced, and accordingly the service life of the gas discharge display panel is lengthened.

In the above-described embodiment, the opening in the cathode electrode is described as being round. However, it should be noted that the configuration of the opening or the discharge cell is not limited thereto or thereby. That is, the opening may be square or substantially square as shown in FIGS. 7A through 7C. In this case, the diameter $D_{2'}$ of the opening in the cathode electrode corresponds to the length $D_2$ of each side of the square.

As is apparent from the above description, in the DC discharge type gas discharge display panel according to the invention, the discharge operation is stable and the negative glow spreads from the periphery of the opening in the cathode electrode towards the front plate. Thus, the display brightness and light emission efficiency is remarkably improved.

The selection of the size $D_2$ (the dimension of each side in the case of a square opening) of the opening in the cathode and thickness T of the cathode so as to meet the following conditions:

$$4\lambda_e \leqq D_2 \leqq 500\lambda_3 \text{ and} \quad (1)$$

$$10\lambda_e \leqq T \leqq 100\lambda_e, \quad (2)$$

the selection in the case of a round opening in the cathode, of the diameter $D_{2'}$ thereof and the thickness T' of the cathode so as to satisfy the following conditions:

$$40\lambda_e = D_{2'} = 500\lambda_e \text{ and} \quad (1)'$$

$$25\lambda_e = T' = 100\lambda_e, \text{ and} \quad (2)'$$

the selection of the distance S in the discharge space for forming the negative glow between the front plate and the cathode electrode so as to satisfy the following condition (4) with the discharge cell diameter $D_{1'}$ and the diameter $D_2$ of the opening in the cathode electrode to meet the following conditions:

$$D_{1'} > D_{2'} \text{ and } 25\lambda_e \leqq D_{1'} \leqq 500\lambda_e, \text{ and} \quad (3)$$

$$25\lambda_e \leqq S \leqq 70\lambda_e, \quad (4)$$

have been described individually. However, if a gas discharge display panel is constructed satisfying all of the above-described conditions, then the display brightness and light emission efficiency will be more remarkably improved.

Another embodiment of a gas discharge display panel according to the invention will be described with reference to FIGS. 9 and 10 which those components which have been previously described are similarly numbered and their detailed descriptions will be omitted.

Figure 9A:
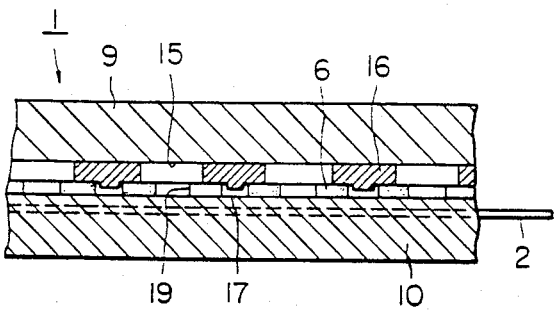
FIGS. 9A and 9B are a sectional view showing another embodiment of a gas discharge display panel according to the invention which includes two structural members.
Figure 10:
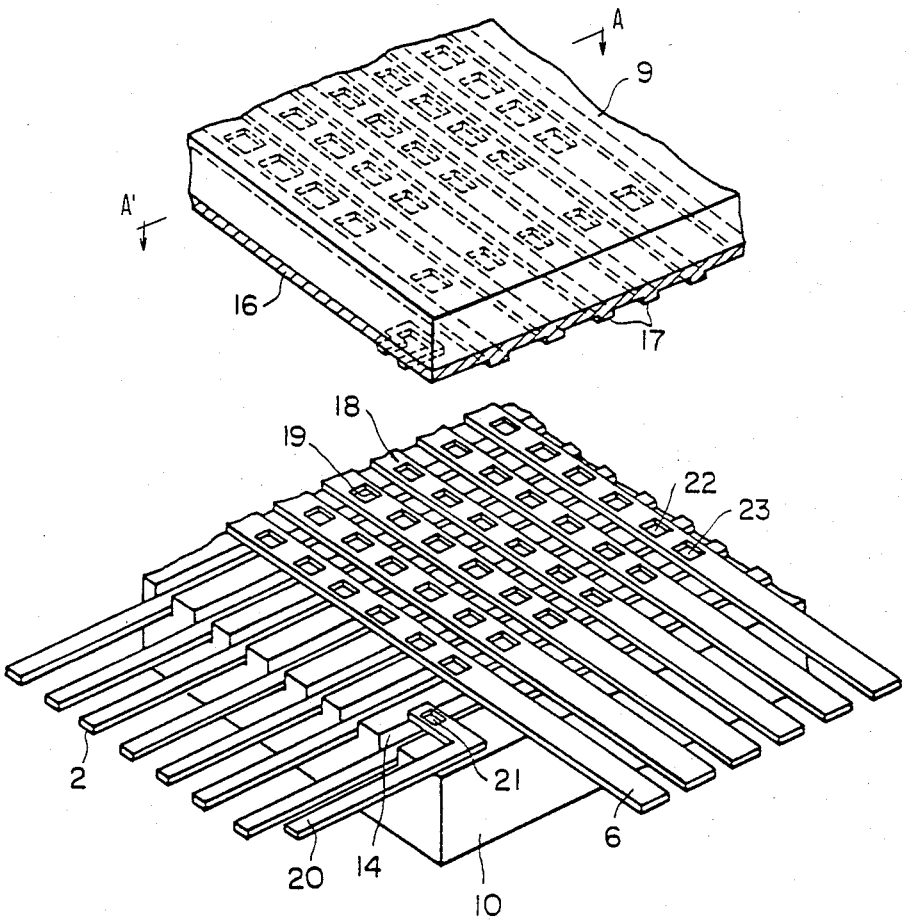
FIG. 10 is an exploded perspective view of the gas discharge display panel of FIG. 9A.

In the gas discharge display panel of FIGS. 9 and 10, a front plate 9 and a rear plate 10 form two opposed outer walls of a vacuum container. The rear plate 10 is made of an insulating material such as glass plate in the inner surface of which a number of parallel grooves 14 are formed to receive anode electrodes 2. The front plate 9 is also made of an insulating transparent material such as transparent glass plate on the inner surface of which a number of parallel cathode electrode 6 are arranged orthogonal to the anode electrodes 2.

Recesses 15 are formed in the inner surface of the front plate 9 at the intersections of the anode electrodes 2 and the cathode electrodes 6, respectively (see, FIG. 9A, a sectional view along line A—A' of FIG. 10). More specifically, the grooves 14 are cut in the inner surface of the rear plate 10 to a predetermined depth, 200μ for instance, by photoetching while the anode electrodes 2 made of an Fe—Ni—Cr alloy or an Fe—Ni alloy are laid in the grooves 14, the anode electrodes being about 200μ in width. The anode electrodes may be formed in the grooves 14 using flint-glass for convenience in manufacture. If the anode electrodes are scarcely bent as they are short, they may be merely laid in the grooves and it is unnecessary to fixedly secure the anode electrode to the grooves 14.

When the grooves 14 are formed in the inner surface of the rear plate 10, simultaneously, elongated banks are formed between adjacent grooves. The banks thus formed are barriers for preventing unwanted discharge between adjacent discharge cells.

Figure 9B:
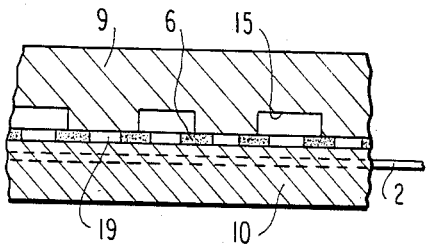

The inner surface of the front plate 9 is covered as shown in FIG. 9A with a black insulating layer 16 of glass powder which is formed to a suitable thickness by thickfilm printing in such a manner that the portions of the front plate inner surface corresponding to the discharge cells are not covered thereby, thus to provide the above-described recesses 15. The recesses 15 may be cut directly in the inner surface of the front plate 9 as illustrated in FIG. 9B. In this case, it is unnecessary to provide the black insulating layer 16.

The portions of the black insulating layer 16 which correspond to resetting auxiliary discharge cells 21 and character displaying auxiliary discharge cells 22 are closed so that the discharge therein cannot be observed.

The depth of each recess 15 is so selected as to satisfy the aforementioned expression (4) so that the negative glow spreads over the upper surface of the cathode electrode 6 from the opening therein so as to generate a discharge with a high brightness. The inside of the recess 15 may be coated with a fluorescent material having a desired color. However, the coating is unnecessary in the case where a negative glow discharge of an acceptable color is generated.

Barriers 17 are formed to a thickness of 30μ with glass powder by thick-film printing on the portions of the black insulating layer 16 which confront gaps 200μ wide between adjacent cathode electrodes 6 in such a manner that the barriers 17 extend along the cathode electrodes 6. The barriers 17 serve to prevent the cathode electrodes 6 from moving sidewards during the manufacture of the gas discharge display panel, to provide a satisfactory display operation, and to prevent deterioration of the insulating material due to contact of adjacent cathode electrodes 6. Following the formation of the barriers 17, a number of cathodes 6 having a thickness of 75μ are arranged on the black insulating layer 15, which is fixed in position by the barriers 17, using a "vehicle" composed of nitrocellulose and isoamyl acetate in a manner so at to meet the aforementioned expression (2).

The charged particles are transferred through a gap having a width of about 45μ between the top of the barrier 17 between adjacent cathode electrodes and the inner surface of the rear plate 10.

A number of small holes 19 are cut in the portions of the cathode electrodes 6 which correspond to character displaying discharge cells 18 forming picture elements. The size of the holes is selected so as to satisfy one of the expression (1) or (1)', depending on the configuration thereof. The barriers for preventing erroneous discharge are provided between adjacent anode electrodes 2. However, erroneous discharge will not occur between adjacent cathode electrodes because the cathode electrodes are at different DC potentials, and therefore no barriers need be provided for the cathode electrodes.

In the figure, reference numeral 20 designates a resetting auxiliary cathode electrode which is arranged between adjacent character anode electrodes 2. The cathode electrode 20 is bent through 90 degrees near the resetting auxiliary discharge cell 21 to be orthogonal to the anode electrodes 2, thus contributing to the transfer of charged particles to the character displaying auxiliary discharge cell 22. An electric discharge is effected in the resetting auxiliary discharge cell 21 by the application of the DC voltage at all times. The charged particles provided by this discharge are transferred to the first of the juxtaposed character displaying auxiliary discharge cells 22 and are then transferred successively from the first to the last cells. Thus, the electric discharge is shifted from the character displaying auxiliary discharge cells to the character displaying discharge cells 18. As the discharge operation is repeatedly carried out with a predetermined period, the charged particles are transferred from the resetting auxiliary discharge cell 21 to the character displaying auxiliary discharge cells 22.

As described above, the front plate 9 and the rear plate 10 form the outer walls of the vacuum container whose peripheral portions are sealed with frit glass. A suitable gas such as He, Ne, Ar or Xe is sealed in the vacuum container to form the gas discharge display panel. It is preferable to coat the inner surface of the front plate 9 with black paint in order to improve the contrast of the discharge display thereby to make the contents of the discharge display more clear.

Figure 11:
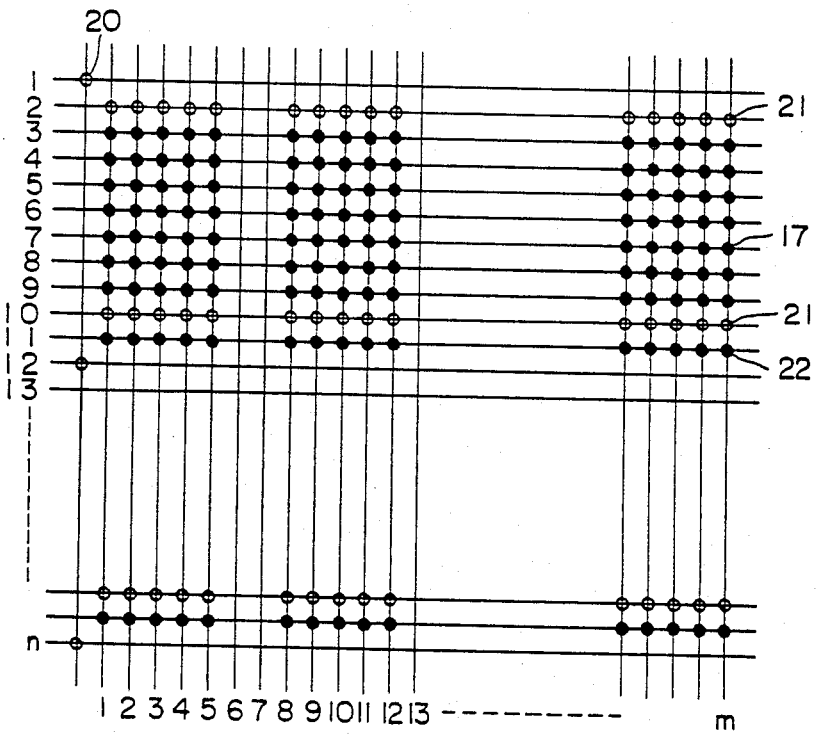
FIG. 11 is an explanatory diagram showing the arrangement of the discharge cells in the case of a character display.

An example of a method for driving the gas discharge display panel according to the invention will be briefly described. FIG. 11 is an explanatory diagram showing an example of the arrangement of the character displaying discharge cells 18, the character displaying auxiliary discharge cells 22, the resetting auxiliary discharge cells 21 and cursors 23. The anode electrodes 2 are arranged horizontally in n lines and the cathode electrodes 6 are arranged vertically in m lines in such a manner that the anode electrodes 2 are orthogonal to the cathode electrodes 6. The discharge cells are provided at the intersections of the electrodes 2 and 6 thus arranged. 5×7 discharge cells form one display character or digit. The zero-th cathode electrode 6 and the first, twelfth, . . . anode electrodes 2 form the resetting auxiliary discharge cells 21 where the discharge is effected with the DC voltage at all times. The charged particles provided by the resetting auxiliary discharge are transferred successively to the character displaying auxiliary discharge cells 22 which are formed by the first through m-th cathode electrodes 6 and the second, tenth, . . . anode electrodes 2, and to the character displaying discharge cells 18. A positive voltage is applied to the second, tenth, . . . anodes 2 while a negative pulse is applied successively to the first, second, third, . . . m-th cathode electrodes 6 so that the auxiliary discharge cells 22 are activated one after another. While a negative pulse is applied to the cathode electrodes 6 successively, a positive voltage is applied to the third, fourth, . . . ninth, eleventh . . . anode electrodes 2 by a character generator (not shown) in synchoronization with the application of the negative pulse so that a desired character is displayed.

"Self-scanning" can be achieved by commonly connecting the cathode electrodes of adjacent characters. The fact that the grooves 14 in the rear plate 10 are arranged in the scanning direction contributes to the smooth operation of the self-scanning.

As is apparent from the above description, the gas discharge display panel according to the invention is simple in construction with the front and rear plates functioning as outer wall. More specifically, it is unnecessary to provide spacers, the use of which lowers productivity and increases the manufacturing cost. In other words, in the manufacture of the gas discharge display panel of the invention, the cost required for cutting holes in the spacers is eliminated. Furthermore, the display panel can be readily assembled because of the construction thereof is simple as described above. Thus, the display panel of the invention can be manufactured at low cost.

In addition, because of the simple construction of the display panel, the components can be easily handled in assembly. The display panel of the invention is suitable especially as a large screen display panel as it has a high resolution.

Moreover, the recesses formed to the predetermined depth in the portions of the inner surface of the front plate which correspond to the intersections of the cathode electrodes and the anode electrodes allow the negative glow to spread, thereby to effect the display at high brightness. The discharge display can be made in a desired color by coating the bottoms of the recesses with a fluorescent material emitting a desired color of light.

What is claimed is:

1. A gas discharge display panel comprising: a front plate and a rear plate disposed opposite one another and forming opposed outer walls of a vacuum container, said front and rear plates being made of an insulating material, a plurality of parallel grooves being formed in an inner surface of said rear plate with elongated banks being formed between adjacent grooves; a plurality of parallel anode electrodes, one of said anode electrodes being disposed in each of said parallel grooves; and a plurality of parallel cathode electrodes disposed on an inner surface of said front plate orthogonal to said anode electrodes, said cathode electrodes having openings formed therein at intersections of said cathode electrodes and said anode electrodes, recesses being formed in said front plate at said intersections of said anode electrodes and said cathode electrodes, means disposed on said cover plate extending parallel to said cathode electrodes to align said cathode electrodes and prevent contact with each other, and wherein a thickness T of said cathode electrodes is defined by $10\lambda_e \leqq T \leqq 100\lambda_e$, where $\lambda_e$ is the electron mean free path in a gas sealed in said display panel.

2. The gas discharge display panel as claimed in claim 1 further comprising a black insulating layer of glass powder disposed on said inner surface of said front plate, said recesses being formed in said black insulating layer.

3. The gas discharge display panel as claimed in claim 1 further comprising a coating of fluorescent material disposed inside each said recess.

4. The gas discharge display panel as claimed in claim 1 wherein the depth of said grooves in said rear plate is approximately 200$\mu$ and wherein said anode electrodes are formed from a material selected from the group consisting of Fe—Ni—Cr alloy and Fe—Ni alloy.

5. The gas discharge display panel as claimed in claim 2 wherein said means disposed on said cover plate comprises barriers formed by said black insulating layer on said front plate between adjacent cathode electrodes.

6. The gas discharge display panel as claimed in claim 1 further comprising a plurality of resetting auxiliary cathode electrodes disposed between adjacent character anode electrodes.

7. The gas discharge display panel as claimed in claim 1 wherein said recesses are provided directly in said front plate, and said means disposed on said cover plate comprises parallel spaced portions of said front plate contacting adjacent cathode electrodes and maintaining spacing therebetween.

8. A gas discharge display panel comprising: a front plate and a rear plate disposed opposite one another and forming opposed outer walls of a vacuum container, said front and rear plates being made of an insulating material, a plurality of parallel grooves being formed in an inner surface of said rear plate with elongated banks being formed between adjacent grooves; a plurality of parallel anode electrodes, one of said anode electrodes being disposed in each of said parallel grooves; and a plurality of parallel cathode electrodes disposed on an inner surface of said front plate orthogonal to said anode electrodes, said cathode electrodes having openings formed therein at intersections of said cathode electrodes and said anode electrodes, recesses being formed in said front plate at said intersections of said anode electrodes and said cathode electrodes, means disposed on said cover plate extending parallel to said cathode electrodes to align said cathode electrodes and prevent contact with each other, and wherein a distance S between said front plate and each said cathode electrode is defined by $25\lambda_e \leqq S \leqq 70\lambda_e$, where $\lambda_e$ is the electron mean free path in a gas sealed in said display panel.

9. The gas discharge panel as claimed in claim 8 further comprising a black insulating layer of glass powder disposed on said inner surface of said front plate, said recesses being formed in said black insulating layer.

10. The gas discharge display panel as claimed in claim 9 wherein said means disposed on said cover plate comprises barriers formed by said black insulating layer on said front plate between adjacent cathode electrodes.

11. The gas discharge display panel as claimed in claim 8 further comprising a coating of fluorescent material disposed inside each said recess.

12. The gas discharge display panel as claimed in claim 8 wherein the depth of said grooves in said rear plate is approximately 200$\mu$ and wherein said anode electrodes are formed from a material selected from the group consisting of Fe—Ni—Cr alloy and Fe—Ni alloy.

13. The gas discharge display panel as claimed in claim 8 further comprising a plurality of resetting auxiliary cathode electrodes disposed between adjacent character anode electrodes.

14. A gas discharge display panel comprising: a front plate and a rear plate disposed opposite one another and forming opposed outer walls of a vacuum container, said front and rear plates being made of an insulating material, a plurality of parallel grooves being formed in an inner surface of said rear plate with elongated banks being formed between adjacent grooves; a plurality of parallel anode electrodes, one of said anode electrodes being disposed in each of said parallel grooves; and a plurality of parallel cathode electrodes disposed on an inner surface of said front plate orthogonal to said anode electrodes, said cathode electrodes having openings formed therein at intersections of said cathode electrodes and said anode electrodes, recesses being formed in said front plate at said intersections of said anode electrodes and said cathode electrodes, means disposed on said cover plate extending parallel to said cathode electrodes to align said cathode electrodes and prevent contact with each other, and wherein said openings of said cathode electrodes are rectangular and wherein a length $D_2$ of one side of each of said rectangular openings is defined by $40\lambda_e \leqq D_2 \leqq 500\lambda_e$, where $\lambda_e$ is the electron mean free path in a gas sealed in said display panel.

15. The gas discharge display panel as claimed in claim 14 further comprising a black insulating layer of glass powder disposed on said inner surface of said front plate, said recesses being formed in said black insulating layer.

16. The gas discharge display panel as claimed in claim 15 wherein said means disposed on said cover plate comprises barriers formed by said black insulating layer on said front plate between adjacent cathode electrodes.

17. The gas discharge display panel as claimed in claim 14 further comprising a coating of fluorescent material disposed inside each said recess.

18. The gas discharge display panel as claimed in claim 14 wherein the depth of said grooves in said rear plate is approximately 200$\mu$ and wherein said anode electrodes are formed from a material selected from the group consisting of Fe—Ni—Cr alloy and Fe—Ni alloy.

19. The gas discharge display panel as claimed in claim 14 further comprising a plurality of resetting auxiliary cathode electrodes disposed between adjacent character anode electrodes.

20. A gas discharge display panel comprising: a front plate and rear plate disposed opposite one another and forming opposed outer walls of a vacuum container, said front and rear plates being made of an insulating material, a plurality of parallel grooves being formed in an inner surface of said rear plate with elongated banks being formed between adjacent grooves; a plurality of parallel anode electrodes, one of said anode electrodes being disposed in each of said parallel grooves; and a plurality of parallel cathode electrodes disposed on an inner surface of said front plate orthogonal to said anode electrodes, said cathode electrodes having openings formed therein at intersections of said cathode electrodes and said anode electrodes, recesses being formed in said front plate at said intersections of said anode electrodes and said cathode electrodes, means disposed on said cover plate extending parallel to said cathode electrodes to align said cathode electrodes and prevent contact with each other, and wherein said openings in said cathodes are circular, a diameter $D_{2'}$ of each said circular opening being defined by $40\lambda_e \leqq D_{2'} \leqq 500\lambda_e$ is the electron mean free path in a gas sealed in said display panel.

21. The gas discharge display panel as claimed in claim 20 further comprising a black insulating layer of glass powder disposed on said inner surface of said front plate, said recesses being formed in said black insulating layer.

22. The gas discharge display panel as claimed in claim 21 wherein said means disposed on said cover plate comprises barriers fromed by said black insulating layer on said front plate between adjacent cathode electrodes.

23. The gas discharge display panel as claimed in claim 20 further comprising a coating of fluorescent material disposed inside each said recess.

24. The gas discharge panel as claimed in claim 20 wherein the depth of said grooves in said rear plate is approximately 200$\mu$ and wherein said anode electrodes are formed from a material selected from the group consisting of Fe—Ni—Cr alloy and Fe—Ni alloy.

25. The gas discharge display panel as claimed in claim 20 further comprising a plurality of resetting auxiliary cathode electrodes disposed between adjacent character anode electrodes.

26. A gas discharge display panel comprising: a front plate and a rear plate disposed opposite one another and forming opposed outer walls of a vacuum container, said front and rear plates being made of an insulating material, a plurality of parallel grooves being formed in an inner surface of said rear plate with elongated banks being formed between adjacent grooves; a plurality of parallel anode electrodes, one of said anode electrodes being disposed in each of said parallel grooves; and a plurality of parallel cathode electrodes disposed on an inner surface of said front plate orthogonal to said anode electrodes, said cathode electrodes having openings formed therein at intersections of said cathode electrodes and said anode electrodes, recesses being formed in said front plate at said intersections of said anode electrodes and said cathode electrodes, and wherein a thickness T of said cathode electrodes is defined by $10\lambda_e \leqq T \leqq 100\lambda_e$ where $\lambda_e$ is the electron mean free path in a gas sealed in said display panel.

27. A gas discharge display panel comprising: a front plate and a rear plate disposed opposite one another and forming opposed outer walls of a vacuum container, said front and rear plates being made of an insulating material, a plurality of parallel grooves being formed in an inner surface of said rear plate with elongated banks being formed between adjacent grooves; a plurality of parallel anode electrodes, one of said anode electrodes being disposed in each of said parallel grooves; and a plurality of parallel cathode electrodes disposed on an inner surface of said front plate orthogonal to said anode electrodes, said cathode electrodes having openings formed therein at intersections of said cathode electrodes and said anode electrodes, recesses being formed in said front plate at said intersections of said anode electrodes and said cathode electrodes, and wherein a distance S between said front plate and each said cathode electrode is defined by $25\lambda_e \leqq S \leqq 70\lambda_e$, where $\lambda_e$ is the electron mean free path in a gas sealed in said display panel.

28. A gas discharge display panel comprising: a front plate and a rear plate disposed opposite one another and forming opposed outer walls of a vacuum container, said front and rear plates being made of an insulating material, a plurality of parallel grooves being formed in an inner surface of said rear plate with elongated banks being formed between adjacent grooves; a plurality of parallel anode electrodes, one of said anode electrodes being disposed in each of said parallel grooves; and a plurality of parallel cathode electrodes disposed on an inner surface of said front plate orthogonal to said anode electrodes, said cathode electrodes having openings, formed therein at intersections of said cathode electrodes and said anode electrodes, recesses being formed in said front plate at said intersections of said anode electrodes and said cathode electrodes, and wherein said openings of said cathode electrodes are rectangular and wherein a length $D_2$ of one side of each of said rectangular openings is defined by $40\lambda_e \leqq D_2 \leqq 500\lambda_e$, where $\lambda_e$ is the electron mean free path in a gas sealed in said display panel.

29. A gas discharge display panel comprising: a front plate and a rear plate disposed opposite one another and forming opposed outer walls of a vacuum container, said front and rear plates being made of an insulating material, a plurality of parallel grooves being formed in an inner surface of said rear plate with elongated banks being formed between adjacent grooves; a plurality of parallel anode electrodes, one of said anode electrodes being disposed in each of said parallel grooves; and a plurality of parallel cathode electrodes disposed on an inner surface of said front plate orthogonal to said anode electrodes, said cathode electrodes having openings formed therein at intersections of said cathode electrodes and said anode electrodes, recesses being formed in said front plate at said intersections of said anode electrodes and said cathode electrodes, and wherein said openings in said cathodes are circular, a diameter $D_{2'}$ of each said circular opening being defined by $40\lambda_e \leqq D_{2'} \leqq 500\lambda_e$, where $\lambda_e$ is the electron mean free path in a gas sealed in said display panel.

* * * * *